United States Patent [19]

Nishikawa et al.

[11] Patent Number: 4,730,174

[45] Date of Patent: Mar. 8, 1988

[54] DIELECTRIC MATERIAL COAXIAL RESONATOR WITH IMPROVED RESONANCE FREQUENCY ADJUSTING MECHANISM

[75] Inventors: Toshio Nishikawa, Nagaokakyo; Koji Saito; Toshiro Hiratsuka, both of Takatsuki, all of Japan

[73] Assignee: Murata Manufacturing Co., Ltd., Nagaokakyo, Japan

[21] Appl. No.: 942,057

[22] Filed: Dec. 18, 1986

Related U.S. Application Data

[63] Continuation of Ser. No. 608,082, May 8, 1984, abandoned.

[30] Foreign Application Priority Data

May 10, 1983 [JP] Japan ..... 58-70014

[51] Int. Cl.[4] ..... H01P 7/04

[52] U.S. Cl. ..... 333/224; 333/226

[58] Field of Search ..... 333/222-226, 333/235, 206, 207, 202

[56] References Cited

U.S. PATENT DOCUMENTS

| | | | |
|---|---|---|---|
| 2,556,607 | 12/1951 | Wheeler | 333/222 |
| 2,562,921 | 8/1951 | Kandoian | 333/222 X |
| 3,703,689 | 11/1972 | McAtee | 333/223 |
| 4,178,562 | 12/1979 | Tormo et al. | 333/232 X |
| 4,398,164 | 8/1983 | Nishikawa et al. | 333/222 |
| 4,434,410 | 2/1984 | Miyake et al. | 333/224 |
| 4,631,506 | 12/1986 | Makimoto et al. | 333/207 X |

*Primary Examiner*—Eugene R. LaRoche
*Assistant Examiner*—Benny Lee
*Attorney, Agent, or Firm*—Wenderoth, Lind & Ponack

[57] ABSTRACT

The disclosure is directed to a dielectric material coaxial resonator provided with an improved resonance frequency adjusting mechanism which is arranged to eliminate deviations of the resonance frequency after adjustment for adjusting the resonance frequency.

7 Claims, 6 Drawing Figures

DIELECTRIC MATERIAL COAXIAL RESONATOR WITH IMPROVED RESONANCE FREQUENCY ADJUSTING MECHANISM

This application is a continuation of now abandoned application Ser. No. 608,082, filed May 8, 1984.

BACKGROUND OF THE INVENTION

The present invention generally relates to a coaxial resonator and more particularly, to a dielectric material coaxial resonator employing a dielectric material block, and provided with an improved resonance frequency adjusting mechanism.

Commonly, as shown in FIG. 1, a ¼ wavelength coaxial TEM resonator includes a dielectric material member 3, for example, of a titanium oxide group ceramic dielectric material or the like provided between an inner conductor 1 and an outer conductor 2. More specifically, a material having superior high frequency electrical conductivity and having a favorable adhesion with respect to the dielectric material member 3, for example, silver paste is baked onto the inner wall surface i.e. the peripheral surface of a through-opening 5 formed in the dielectric material member 3 and the outer wall surface of said dielectric material member 3 to form the inner conductor 1 and the outer conductor 2, with said inner and outer conductors 1 and 2 being short-circuited by an electrode or conductive layer 4 formed on one end face of the dielectric material member 3, thus providing a short-circuited end 3*a* on said one end face and an open end 3*b* on the other end face of said dielectric material member 3.

Conventionally, for a resonance frequency adjusting mechanism of a ¼ wavelength coaxial TEM resonator of the above described type, there has generally been known an arrangement in which a sleeve 6 formed with an internally threaded portion 6*s* therein is fitted into the through-opening 5 against the inner conductor 1 at the open end 3*b* of the dielectric material member 3, and an adjusting screw 7 of a metallic material is threaded into the internally threaded portion 6*s* so the resonance frequency can be adjusted by turning or vertically moving the adjusting screw 7.

However, in the resonance frequency adjusting mechanism for the dielectric material coaxial resonator as described above, since the adjusting screw 7 is threaded into the internally threaded portion 6*s* at the inner side of the open end 3*b* of the dielectric material member 3 at which the current is concentrated, there has been a drawback that the path through which the ground current flow is altered, with a consequent instability of the resonance frequency due to side play, etc. before the adjusting screw 7 has been fixed to the internally threaded portion 6*s* by a bonding material or the like.

SUMMARY OF THE INVENTION

Accordingly, an essential object of the present invention is to provide a dielectric material coaxial resonator provided with an improved resonance frequency adjusting mechanism which is capable of eliminating deviations of the resonance frequency after adjustment thereof for adjusting said resonance frequency.

Another important object of the present invention is to provide a dielectric material coaxial resonator of the above described type, which has a simple construction and functions accurately, and can be readily manufactured on a large scale at low cost.

In accomplishing these and other objects, according to one preferred embodiment of the present invention, there is provided a dielectric material coaxial resonator which includes a dielectric material member having a through-opening axially formed therein, an inner conductor formed on the inner wall surface of the through-opening of the dielectric material member and an outer conductor formed on the outer wall surface of the dielectric material member, a conductive layer formed on one end face of the dielectric material member as a short-circuiting end face for conduction between said inner and outer conductors, and a resonance frequency adjusting mechanism which further comprises a resonance frequency adjusting member which alters the resonance frequency of the dielectric material member by being axially moved within said through-opening thereof, spring means which contacts under pressure, the outer peripheral surface of the resonance frequency adjusting member so as to connect said resonance frequency adjusting member with said inner conductor in the vicinity of the open end of the dielectric material member remote from said short-circuited end face thereof, and a displacing mechanism provided at said short-circuited end face of said dielectric material member for displacing said resonance frequency adjusting member through the interior of said through-opening of said dielectric material member.

By the arrangement according to the present invention as described above, a dielectric material coaxial resonator with an improved resonance frequency adjusting mechanism has been advantageously provided.

BRIEF DESCRIPTION OF THE DRAWINGS

These and other objects and features of the present invention will become apparent from the following description of preferred embodiments thereof given with reference to the accompanying drawings, in which.

DETAILED DESCRIPTION OF THE INVENTION

Figure 1:
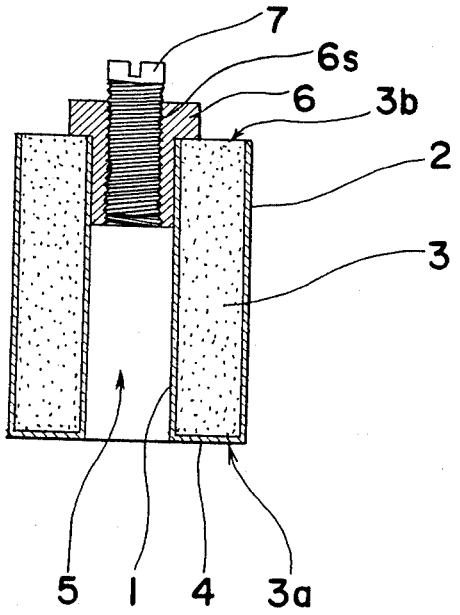
Fig. 1 PRIOR ART
FIG. 1 is a longitudinal sectional view of a conventional dielectric material coaxial resonator having a known resonance frequency adjusting mechanism (already referred to)

Before the description of the present invention proceeds, it is to be noted that like parts are designated by like reference numerals throughout the accompanying drawings.

Figure 2:
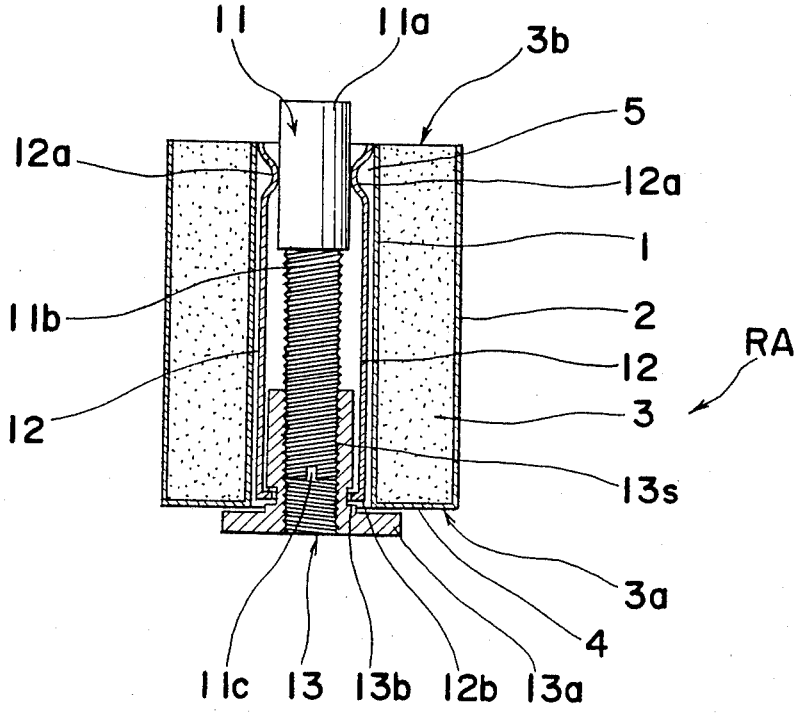
FIG. 2 is a longitudinal sectional view of a dielectric material coaxial resonator provided with an improved resonance frequency adjusting mechanism according to one preferred embodiment of the present invention.

Referring now to the drawings, there is shown in FIG. 2 a dielectric material coaxial resonator RA provided with a resonance frequency adjusting mechanism according to one preferred embodiment of the present invention. The coaxial resonator RA includes a dielectric material body 3 having a through-opening or axial bore 5 extending therethrough generally at its central portion, an inner conductor 1 formed on the peripheral surface of the axial bore 5, an outer conductor 2 formed on the outer wall surface of the dielectric material body 3, and an electrode or conductive layer 4 formed on one end face of the body 3 for connection between the inner conductor 1 and the outer conductor 2, and thus, a short-circuited end 3a is provided on said one end, with an open end **3*b* formed on the other end face of the body 3 in the similar manner as in the known ¼ wavelength coaxial TEM resonator described earlier with reference to FIG. 1. In the resonator RA of FIG. 2 according to the present invention, the resonance frequency adjusting mechanism further includes a metallic bar 11 constituting a resonance frequency adjusting member arranged to move through the interior of the through-opening 5 in the axial direction of the dielectric material body 3, a pair of opposed plate springs 12 provided within the through-opening 5, with confronting contact portions 12*a* which are formed on upper portions of the plate springs 12 being held under pressure contact against the outer peripheral surface of the metallic bar 11 as shown, and first member in the form of a sleeve 13 having an internally threaded portion 13*s* axially formed therein and a movable member 11*b* threaded therein and on which said bar is mounted ofr displacing the metallic bar 11 within the through-opening 5 of the dielectric material body 3**.

More specifically, the metallic bar 11 is prepared by cutting a round metallic rod (not shown), for example, of brass or the like into the bar 11 having a length approximately equal to that of the dielectric material body 3, and the moveable member is formed as an external thread **11*b* on the bar 11 other than at a frequency adjusting portion 11*a* provided at its one end, while a groove 11*c* for rotating the moveable member 11*b* by fitting an edge of a screw driver (not shown), etc. thereinto is formed in the end face at the other end of said moveable member 11*b* from said bar 11**.

Each of the plate springs 12 has the contact portion **12*a* formed adjacent to one end thereof for contact with the frequency adjusting portion 11a of the metallic bar 11, while the other end of the plate spring 12 is bent inwardly at approximately right angles thereto so as to form a retaining portion 12*b* for the sleeve 13 having the internally threaded portion 13*s***.

The sleeve 13 formed with the internally threaded portion **13*s* has a flange portion 13*a* with a diameter larger than that of the through-opening 5 of the dielectric material block 3, and is provided with an annular retaining groove 13*b* at its neck portion adjacent to the flange portion 13*a* for receiving the retaining portions 12*b* of the plate springs 12 therein. For preventing the sleeve 13 itself from undesirable rotation, said sleeve 13** is fixed to the coaxial resonator, for example, by a bonding agent.

Within the through-opening 5 of the dielectric material block 3, the pair of plate springs 12 are inserted, with upper ends thereof being engaged with the inner conductor 1 at positions close to the open end **3*b* of the dielectric material body 3, while the metallic bar 11 is fitted in between the plate springs 12, with the contact portions 12*a* of the plate springs 12 being held under pressure contact against the outer peripheral surface of the resonance frequency adjusting portion 11*a* of the metallic bar 11. Moreover, at the other ends of the plate springs 12, the retaining portions 12*b* of the plate springs 12 are fitted into the retaining groove 13*b* of the sleeve 13 for the internal thread 13*s*, with the external thread of moveable member 11*b* being engaged with said internal thread 13*s* of the sleeve 13**.

The internally threaded portion **13*s* of the sleeve 13 and the externally threaded moveable member 11*b* constitute a mechanism for displacing the metallic bar 11 as a resonance frequency adjusting member, and by turning the moveable member 11*b*, with the tip of a screw driver (not shown) being fitted in the groove 11*c* at the end of the member 11*b* adjacent the the short-circuited end 3*a* of the dielectric material body 3, the frequency adjusting portion 11*a* of the metallic bar 11 selectively moves out of or into the open end 3*b* of the dielectric material block 3**, and thus, the ¼ wavelength coaxial TEM resonator has its effective length varied, with a consequent variation of the resonance frequency thereof.

In the above case, the frequency adjusting portion **11*a* of the metallic bar 11 is adapted to be connected to the inner conductor 1 at a predetermined position close to the open end 3*b* of the dielectric material block 3 through the contact portions 12*a* of the plate springs 12, and even if there is side play or looseness of the metallic bar 11, the frequency adjusting portion 11*a* of the metallic bar 11 is connected to said inner conductor 1 at the predetermined position as described above through said contact portions 12*a***, and thus, the undesirable variation of the resonance frequency is almost eliminated.

Figure 3:
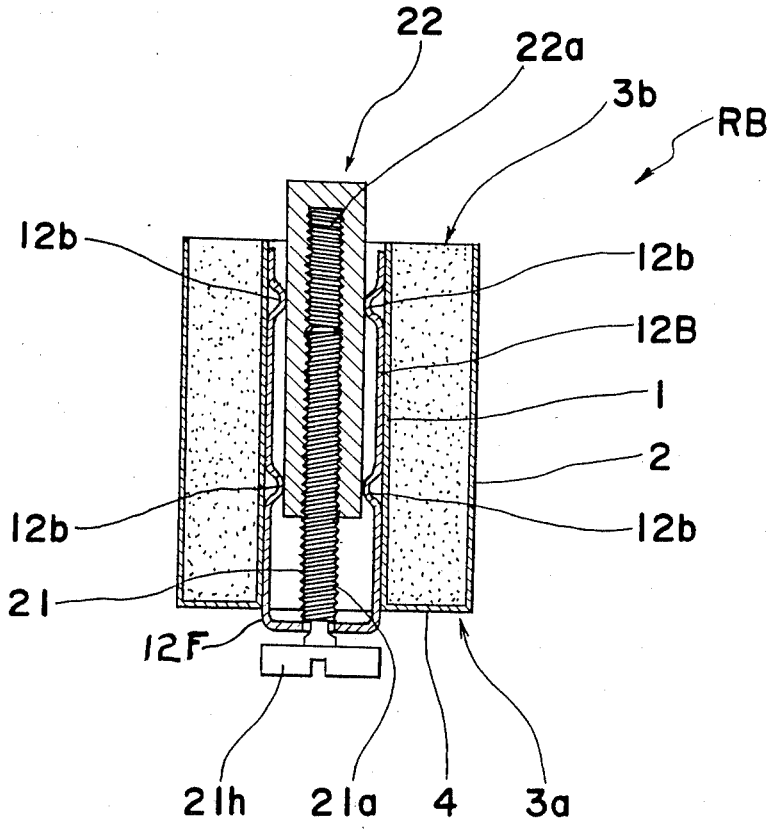
FIG. 3 is a view similar to FIG. 2, which particularly shows a modification thereof.

Referring further to FIG. 3, there is shown a modification of the coaxial resonator RA of FIG. 2. In the modified coaxial resonator RB in FIG. 3, the metallic bar 11 , plate springs 12, and the sleeve 13 having the internal thread **13*s*, described as employed in the arrangement of FIG. 2, are replaced by a moveable member in the form of an adjusting screw 21 provided with an external thread 21*a* and having a large head portion 21*h*, and rotatably supported at the short-circuited end 3*a* in a fixed member 12F having plate springs 12B extending integrally therefrom, while the external thread 21*a* of the adjusting screw 21 is engaged with an internally threaded opening 22*a* axially formed in a metallic bar 22 constituting the resonance frequency adjusting member, whereby upon rotation of the head portion 21*h* of the above adjusting screw 21 , the metallic bar 22 is displaced between the contact portions 12*b* of the opposed plate springs 12B so as to emerge from or enter the open end face 3*b* of the dielectric material member 3**.

Figure 4:
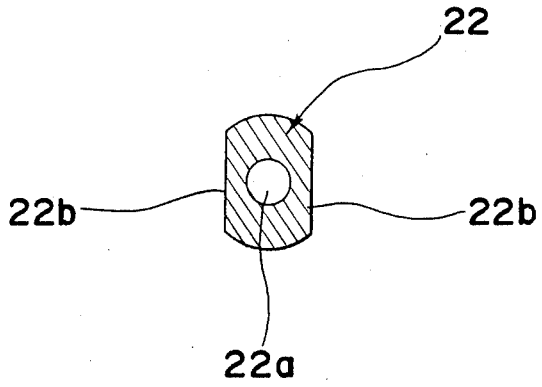
FIG. 4 is a cross section of a metallic bar employed in the resonance frequency adjusting mechanism of the dielectric material coaxial resonator of FIG. 3, and FIGS. 5 and 6 are longitudinal sectional views of dielectric material coaxial resonators according to further modifications of the present invention in which displacing mechanisms for frequency adjusting bars are provided in the outside casings of the coaxial resonators.

In the modification of FIG. 3, for avoiding simultaneous rotation of the metallic bar 22 together with the adjusting screw 21, the metallic bar 22 is provided with two parallel sliding surfaces **22*b* which are held in sliding contact with contact portions 12*b* (provided at four positions in this embodiment) of the plate springs 12B as shown in FIG. 4**.

By the arrangement of FIG. 3 also, generally similar effects as in the embodiment of FIG. 2 may be obtained.

In the foregoing embodiment, the metallic bar 11 or 22 may be replaced by a similarly shaped member having a metallic film on the surface for application as a resonance frequency adjusting member.

Figure 5:
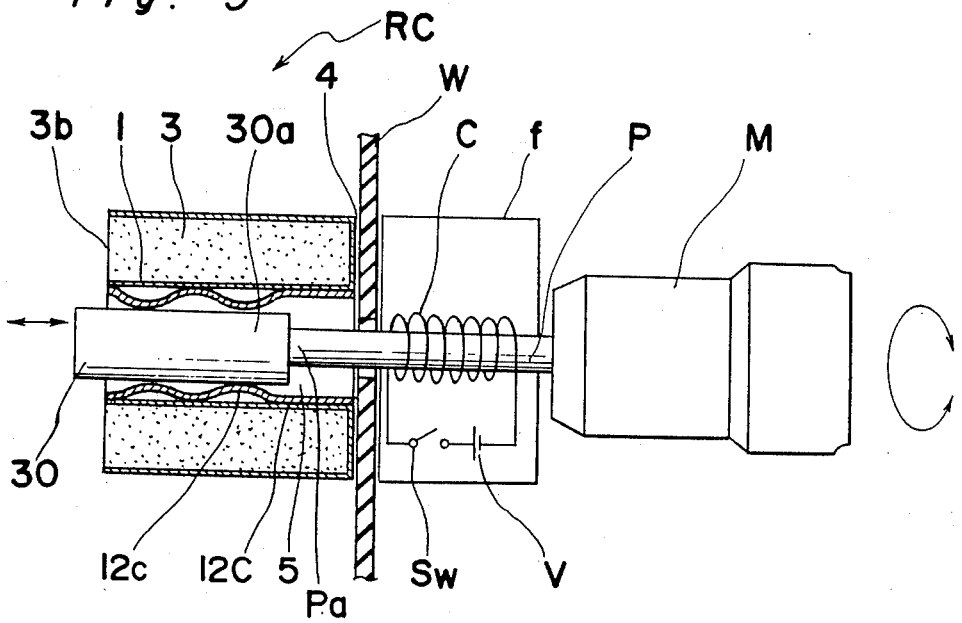
Figure 6:
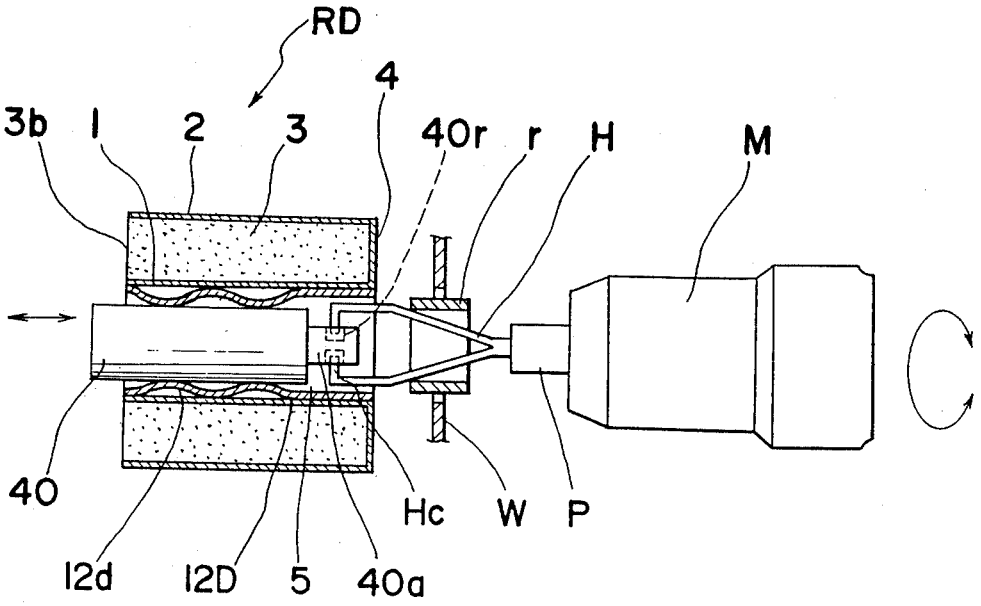

It should be noted here that, in the foregoing embodiment, the displacing mechanism for the adjusting bar 11 or 22 may be modified so that it is outside the casing (partly shown at W in FIG. 5) of a device employing the ¼ wavelength coaxial TEM resonator so that the metallic bar 11 or 22 is moved as shown, for example, in the further modifications illustrated in FIGS. 5 and 6.

In the modified coaxial resonator RC of FIG. 5, the metallic bar 11 described as employed in the resonator RB of FIG. 3 is replaced by a resonance frequency adjusting member in the form of a cylindrical adjusting bar 30 of a magnetizable material held between contact portions 12*c* of plate springs 12C fixed in the inner conductor 1 for the through-opening 5, while a moveable member in the form of a spindle P for an outer sleeve M coupled with a known micrometer mechanism (not particularly shown) accommodated in said outer sleeve, extends through a housing f containing a coil C connected to a power source V through a switch Sw, and a wall W which is a part of the casing with a distal end Pa of the spindle P contacting a corresponding inner end 30*a* of the adjusting bar 30.

In the above arrangement, the switch Sw is turned on for the adjustment so as to magnetize the spindle P by the coil C, and thus, the adjusting bar 30 attracted to the spindle P by the magnetic force of said spindle is moved as the spindle P is displaced by the micrometer mechanism in the outer sleeve M. It should be noted here that in the above case, the spindle P is subjected to very slow or fine displacement, with the positional relationship between the device employing the ¼ wavelength coaxial TEM resonator and the sleeve M being maintained constant. Upon completion of the adjustment, the switch Sw is turned off for de-magnetization of the spindle P. The adjusting bar 30 can be fixed only by the spring force of the plate springs 12C, but a resin may be further applied between the adjusting bar 30 and the plate springs 12C and/or between the plate springs 12C and the inner conductor 1.

In the further modified coaxial resonator RD of FIG. 6, the metallic bar 11 in the coaxial resonator RB of FIG. 3 is also replaced by an adjusting bar 40 having a projecting end 40*a* in which a pair of recesses 40r are formed, and held between contact portions 12*d* of the plate springs 12D in a similar manner as in FIG. 5. The spindle P of the micrometer mechanism in the outer sleeve M of the same construction as that in FIG. 5 has a holder H secured at its end and having a pair of spaced claws Hc which can be engaged with the recesses 40*r* of the projecting end 40*a* of the adjusting bar 40. The holder H is provided with a ring r fitted therearound for manual movement in the axial direction to keep the holder H closed when the claws Hc thereof have been received in the recesses 40*r*.

In the arrangement of FIG. 6 also, the adjusting bar 40 may be displaced and fixed for adjustment in a similar manner as in the arrangement of FIG. 5.

It should also be noted that the present invention is not limited in its application only to the single cylindrical dielectric material coaxial resonator as described so far, but may be readily applied to arrangements in which two or more dielectric material coaxial resonators are formed in one dielectric material body as disclosed, for example, in Japanese Patent Laid-open Application Tokkaisho No. 58-9401.

As is clear from the foregoing description, according to the present invention, since it is arranged so that the resonance frequency adjusting member which is displaced within the dielectric material body for the adjustment of resonance frequency of the dielectric material coaxial resonator is arranged to be connected to the inner conductor in the vicinity of the open end of the resonator by the spring means held under pressure contact with the outer peripheral surface thereof, the resonance frequency adjusting member can be electrically connected to the inner conductor at a predetermined position close to the open end of the inner conductor, and thus, even when a certain amount of side play or looseness is present in the mounting of the resonance frequency adjusting member, there is almost no variation in the resonance frequency. Another advantage of the present invention is such that, as compared with the conventional arrangements in which the resonance frequency is adjusted by scraping off the dielectric material block for alteration of its dimensions, the resonance frequency may be simply adjusted by a screw driver even after assembly of the resonator.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A frequency adjustable dielectric material coaxial resonator comprising:

an elongated dielectric material member having an outer wall surface and opposite end faces and a central longitudinal axis extending in the direction between said opposite end faces and an axial bore extending through said member along said axis;

an inner electric conductor formed on the inner wall surface of said bore and terminating at end faces of said dielectric material member;

an outer electrical conductor formed on the outer wall surface of said dielectric material member and terminating at said one end face and a conductive layer on the other end face electrically connecting said inner and outer conductors, said dielectric material member and said electric conductors defining a resonant system; and a resonance frequency adjusting mechanism insertable as a unit into said bore within said inner conductor and having a displacing mechanism located adjacent said other end face of said dielectric material member, said displacing mechanism having a fixed member fixed relative to said inner conductor and a movable member movable therein, a resonance frequency adjusting member having an elongated shape with an outer peripheral surface and mounted on said movable member and fitted loosely within said bore and projecting out of the end of said bore at the one end face of said dielectric material, said movable member being adjustable for axially moving said adjusting member for moving the end which is toward said one end of said dielectric member out of said resonant system thereby altering the resonance frequency of said resonator, and springs of electrically conductive material mounted on said fixed member of said displacing mechanism and extending along the inner surface of said inner electrical conductor and firmly electrically contacting said inner surface of said inner electrical conductor at at least one point therealong and having free ends contacting the outer peripheral surface of said resonance frequency adjusting member under pressure at at least one point in the vicinity of the one end face of said dielectric material member for providing an electric contact therebetween and firmly supporting said resonance frequency adjusting member substantially axially with respect to said bore, said resonance frequency adjusting member being slidable along said free ends when moved by said movable member.

2. A resonator as claimed in claim 1 wherein said resonance frequency adjusting member has a metallic bar and said movable member is an externally threaded extension on said bar, said springs are plate springs on diametrically opposite sides of said resonance frequency adjusting member, and said fixed member is a cylindrical member having an internally threaded bore extending axially therethrough and in which said threaded extension is threadedly engaged.

3. A resonator as claimed in claim 1 wherein said resonance frequency adjusting member is a metallic bar having an internally threaded axial bore therein, said springs are plate springs on diametrically opposite sides of said metallic bar, and said movable member is an adjusting screw having an externally threaded portion engaged in said threaded axial bore.

4. A resonator as claimed in claim 3 wherein said metallic bar has at least one flat surface along the outer peripheral surface parallel to the axis thereof, said flat surface being contacted by one of said plate springs for preventing said metallic bar from rotating together with said adjusting screw.

5. A frequency adjustable dielectric material coaxial resonator comprising:

an elongated dielectric material member having an outer wall surface and opposite end faces and a central longitudinal axis extending in the direction between said opposite end faces and an axial bore extending through said member along said axis;

an inner electric conductor formed on the inner wall surface of said bore;

an outer electrical conductor formed on the outer wall surface of said dielectrical material member and a conductive layer on one end face electrically connecting said inner and outer conductors;

a bar-shaped resonance frequency adjusting member of magnetic material within said bore and having one end projecting out of said bore at the other end face of said dielectric material member;

a plurality of plate springs along the inner surface of said inner electrical conductor and having projecting portions electrically engaged with said resonance frequency adjusting member for supporting said resonance frequency adjusting member axially with respect to said inner electrical conductor, said resonance frequency adjusting member being slidable along said projecting portions;

a spindle of magnetic material disposed against the end of said bar-shaped resonance frequency adjusting member which is facing toward said one end of said dielectric material member and said spindle extending axially out of said one end of said dielectric material member;

means for moving said spindle toward and away from said dielectric material member for adjusting the position of said bar-shaped resonance frequency adjusting member; and an electromagnet means electromagnetically associated with said spindle and including a power supply and on-off switching means for magnetizing said spindle for holding said resonance frequency adjusting member against said spindle during movement of said resonance frequency adjusting member by said moving means.

6. A frequency adjustable dielectric material coaxial resonator comprising:

an elongated dielectric material member having an outer wall surface and opposite end faces and a central longitudinal axis extending in the direction between said opposite end faces and an axial bore extending through said member along said axis;

an inner electric conductor formed on the inner wall surface of said bore;

an outer electrical conductor formed on the outer wall surface of said dielectric material member and a conductive layer on one end face electrically connecting said inner and outer conductors;

a metallic bar-shaped resonance frequency adjusting member within said bore and having one end projecting out of said bore at the other end face of said dielectric material member;

a plurality of plate springs along the inner surface of said inner electrical conductor and having projecting portions electrically engaged with said resonance frequency adjusting member for supporting said resonance frequency adjusting member for movement axially with respect to said inner electrical conductor, said resonance frequency adjusting member being slidable along said projecting portions;

a spindle mounted on the end of said bar-shaped resonance frequency adjusting member which is facing toward said one end of said dielectric material member and extending axially with respect to said inner conductor;

means for moving said spindle toward and away from said dielectric material member for adjusting the position of said bar-shaped resonance frequency adjusting member; and chuck means on said moving means for selective engagement with and disengagement with said spindle.

7. A resonator as claimed in claim 6 in which said spindle has recesses in free end thereof, and said chuck means has claws thereon for engagement in said recesses for engagement of said chuck means with said spindle.

* * * * *